US010801522B2

(12) United States Patent
Bertoneri

(10) Patent No.: US 10,801,522 B2
(45) Date of Patent: Oct. 13, 2020

(54) SYSTEM AND METHOD FOR DRAINING A WET-GAS COMPRESSOR

(71) Applicant: Nuovo Pignone Srl, Florence (IT)

(72) Inventor: Matteo Bertoneri, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 426 days.

(21) Appl. No.: 15/315,027

(22) PCT Filed: May 28, 2015

(86) PCT No.: PCT/EP2015/061902
§ 371 (c)(1),
(2) Date: Nov. 30, 2016

(87) PCT Pub. No.: WO2015/181327
PCT Pub. Date: Dec. 3, 2015

(65) Prior Publication Data

US 2017/0184131 A1 Jun. 29, 2017

(30) Foreign Application Priority Data

May 30, 2014 (IT) ..... FI2014A0134

(51) Int. Cl.
*F04D 29/70* (2006.01)
*F04D 29/28* (2006.01)
*F04D 17/10* (2006.01)

(52) U.S. Cl.
CPC ..... *F04D 29/706* (2013.01); *F04D 17/10* (2013.01); *F04D 29/284* (2013.01)

(58) Field of Classification Search
CPC ..... F04D 29/706; F04D 17/10; F04D 29/284
(Continued)

(56) References Cited

U.S. PATENT DOCUMENTS 1,316,171 A * 9/1919 Marion ..... F16T 1/24 137/192
4,295,781 A * 10/1981 Ogiwara ..... F03B 15/00 415/1

(Continued)

FOREIGN PATENT DOCUMENTS

CN 102444579 A 5/2012
EP 2 481 902 A2 8/2012

(Continued)

OTHER PUBLICATIONS

First Office Action and Search issued in connection with corresponding CN Application No. 201580028999.3 dated Jun. 28, 2018.

(Continued)

*Primary Examiner* — David Hamaoui
*Assistant Examiner* — John D Bailey
(74) *Attorney, Agent, or Firm* — Baker Hughes Patent Organization

(57) ABSTRACT

A wet-gas compressor is described, comprising a compressor casing and a rotor, for rotation in the compressor casing and comprised of at least one impeller. In the compressor casing, a cavity is provided, where liquid contained in a wet gas can collect during operation of the compressor. A drain port is at the bottom of the cavity and a vent port is above the drain port of the cavity. The drain port and vent port are in fluid communication with a liquid-level measuring chamber. A level gauge is provided at the liquid-level measuring chamber and a drainage valve for discharging liquid from the cavity towards a liquid discharge line connected to the drain port. A control arrangement receives a signal from the level gauge and controls the opening of the drainage valve liquid in the liquid-measuring chamber reaches a threshold level.

14 Claims, 2 Drawing Sheets

(58) Field of Classification Search
USPC ..... 415/169.2
See application file for complete search history.

(56) References Cited

U.S. PATENT DOCUMENTS

| | | | | |
|---|---|---|---|---|
| 8,192,144 | B2 * | 6/2012 | Shibata | F04D 29/4206 415/108 |
| 8,596,292 | B2 * | 12/2013 | Maier | F04B 53/20 137/204 |
| 2004/0194485 | A1 * | 10/2004 | Dudley | F04B 39/0207 62/193 |
| 2005/0247124 | A1 * | 11/2005 | Fukuhara | G01F 23/38 73/290 R |
| 2009/0071187 | A1 * | 3/2009 | Sakitani | F25B 13/00 62/468 |
| 2009/0165480 | A1 * | 7/2009 | Sakitani | F25B 31/004 62/192 |
| 2010/0139776 | A1 * | 6/2010 | Auber | F04D 29/083 137/13 |
| 2012/0055335 | A1 * | 3/2012 | Mateman | F04D 25/16 95/153 |
| 2012/0195740 | A1 * | 8/2012 | Karishuku | F04D 29/701 415/169.2 |
| 2012/0308408 | A1 * | 12/2012 | Rosvold | F04D 13/086 417/199.1 |
| 2016/0018148 | A1 * | 1/2016 | Yura | F25B 31/002 62/192 |
| 2016/0186781 | A1 * | 6/2016 | Borkowski | F04D 29/5826 415/1 |
| 2016/0348681 | A1 * | 12/2016 | Le | F04D 13/0633 |

FOREIGN PATENT DOCUMENTS

| | | | |
|---|---|---|---|
| EP | 2 530 326 | A2 | 12/2012 |
| JP | 2006-57607 | A | 3/2006 |
| RU | 2405976 | C1 | 12/2010 |

OTHER PUBLICATIONS

Italian Search Report and Written Opinion issued in connection with corresponding IT Application No. ITFI2014A000134 dated Feb. 20, 2015.

International Search Report and Written Opinion issued in connection with corresponding PCT Application No. PCT/EP2015/061902 dated Jul. 6, 2015.

International Preliminary Report on Patentibility issued in connection with corresponding PCT Application No. PCT/EP2015/061902 dated Dec. 6, 2016.

Office Action and Search Report issued in connection with corresponding RU Application No. 2016144913 dated Nov. 2, 2018.

* cited by examiner

SYSTEM AND METHOD FOR DRAINING A WET-GAS COMPRESSOR

BACKGROUND

The present disclosure refers to turbomachines. More specifically, the disclosure relates to improvements concerning wet-gas compressors, in particular centrifugal compressors, which process a wet gas, i.e. a gaseous flow containing liquid particles.

In many industries, specifically but not exclusively in oil and gas extraction and processing industry, turbomachines are used, which process a gas that can contain solid or liquid particles entrained in the main gaseous flow processed through the turbomachine. Subsea compressors are typical examples of turbomachines, which process a wet gas, as gaseous hydrocarbons extracted from a gas field often contain heavier hydrocarbons in the form of liquid droplets and/or solid matters dragged by the gas flowing through the turbomachine.

Liquid droplets contained in the gas flow processed by a wet-gas compressor can collect in one or more cavities provided in the compressor casing. For instance, if the discharge nozzle of the compressor is not downwards oriented, some liquid can collect in the outlet volute, where compressed gas from the last compressor stage is collected and wherefrom the compressed gas is delivered towards an outlet manifold. Other cavities where liquid can happen to collect are portions of the diffusers or the return channel arranged between adjacent compressor impellers; cavities adjacent the balancing drum, and other cavities variously positioned in the compressor casing.

Liquid can accumulate either during continuous operation of the machine, or during pressurized stops. In the latter case, liquid can be generated also by the condensation of heavy hydrocarbons due to the cooling of the process flow.

SUMMARY OF THE INVENTION

According to one aspect, the subject matter disclosed herein relates to a wet-gas compressor, comprising a compressor casing and a rotor arranged for rotation in the compressor casing and comprised of at least one impeller. The compressor further comprises at least one cavity for collecting liquid contained in a wet gas processed by the compressor. A drain port is provided at a bottom of the cavity and a vent port is further provided in a position above the drain port of said cavity, the drain port and vent port being in fluid communication with a liquid-level measuring chamber. A level gauge is combined with the liquid-level measuring chamber and a drainage valve is arranged for discharging liquid from the cavity towards a liquid discharge line. Furthermore, a control arrangement is provided, configured for receiving a signal from the level gauge and for controlling the drainage valve such that the drainage valve is opened when liquid in the liquid-level measuring chamber reaches a threshold level.

The wet-gas compressor can be a centrifugal wet-gas compressor. In some embodiments the compressor is a multi-stage compressor, comprised of a plurality of sequentially arranged impellers.

In some embodiments, the compressor comprises a plurality of cavities, each cavity being in fluid communication with a drain port and a vent port. Each cavity is further fluidly connected with a respective liquid-level measuring chamber having a level gauge combined therewith. A respective drainage valve is arranged for discharging liquid from each cavity. One or more control arrangements can be provided for controlling one, some or all the drainage valves, such that each drainage valve is opened when the liquid level in the respective liquid-level measuring chamber reaches a given threshold.

In some embodiments, the level gauge or each level gauge is arranged outside the compressor casing.

The compressor can further comprise a check valve downstream of the drainage valve or of each drainage valve.

According to a further aspect, the subject matter disclosed herein concerns a method for removing a liquid accumulated in a wet-gas compressor, comprising a compressor casing and at least one impeller arranged for rotation in the compressor casing. The method comprising the following steps:

providing at least one cavity or a plurality of cavities in the compressor casing, where liquid separated from the wet gas collects;

providing a drain port arranged at the bottom of each cavity and a vent port arranged above the drain port;

fluidly connecting the vent port and the drain port with a liquid-level measuring chamber provided with a liquid-level gauge;

providing a drainage valve between the cavity and a liquid discharge line;

running the compressor and processing wet gas therethrough;

collecting liquid, separating from the wet gas processed by the compressor, in the cavity;

detecting a liquid level in the liquid-level measuring chamber;

if the liquid in the liquid-level measuring chamber reaches a threshold level, opening the drainage valve to discharge liquid from the cavity and from the chamber.

If a plurality of cavities are present in the compressor casing, each cavity can be provided with a respective drain port, vent port and liquid-level measuring chamber with respective level gauge. A respective drainage valve can be in fluid communication with each cavity and can be controlled based on the level of the liquid detected by the liquid-level gauge associated with the respective liquid-level measuring chamber.

According to some embodiments, the drainage valve is opened while the compressor is running.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

The following description relates to an embodiment of a centrifugal compressor for processing wet gas. Other uses of the subject matter disclosed herein, e.g. in other kinds of compressors where similar liquid accumulation problems occur, are possible.

Figure 1:
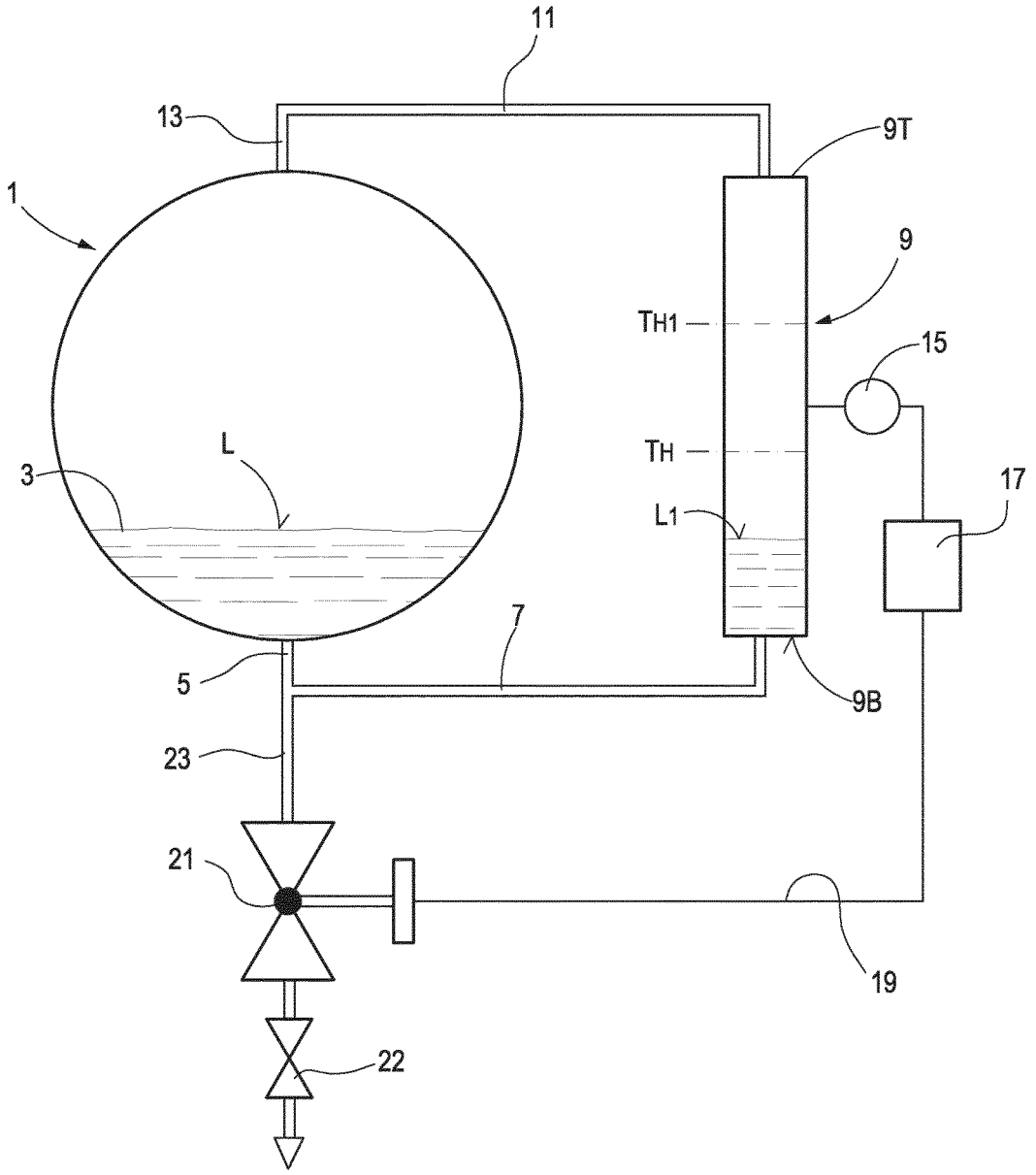
FIG. 1 schematically illustrates a generic cavity, wherein liquid separating from the gas flow can collect, in combination with the respective liquid-level measuring chamber.

FIG. 1 illustrates a diagram explaining the principles for operation of the subject matter disclosed herein. In the schematic of FIG. 1, reference number 1 indicates a compressor casing wherein a cavity 3 is formed. Liquid L separating from a wet-gas flow processed by the compressor can collect at the bottom of cavity 3.

The bottom of the cavity 3 is provided with a drain port 5 in fluid communication, through a line 7, with a liquid-level measuring chamber 9. The line 7 can be connected to the bottom 9B of the liquid-level measuring chamber 9. The top 9T of the liquid-level measuring chamber 9 can be in fluid communication through a line 11 with a vent port 13 at or near the top of cavity 3.

According to some embodiments, the liquid-level measuring chamber 9 can be located outside the compressor casing 1 and lines 7, 11 extend through the compressor casing 1.

A level gauge 15 is arranged at the liquid-level measuring chamber 9 and can be electronically connected to a control unit or control arrangement 17. The control unit 17 can be connected through wiring 19 with a drainage valve 21. The drainage valve 21 is located on a drainage pipe 23 in fluid communication with cavity 3. Opening of the drainage valve 21 causes liquid L in the liquid collected in cavity 3 to be discharged from cavity 3 towards a collecting reservoir or the like (not shown). The control unit 17 can be configured and controlled for selectively opening and closing the drainage valve 21, to prevent the liquid level in cavity 3 to raise above a threshold value which can prejudice the correct operation of the compressor.

The liquid-level measuring chamber 9 and the level gauge 15 are spatially arranged with respect to the cavity 3 such that the liquid level in the cavity 3 can be detected by the level gauge 15, liquid level in the cavity 3 and in the chamber 9 being the same thanks to the fluid connection through both ports 5, 13 and respective lines 7, 11. i.e. the measuring interval of the level gauge 15 is arranged at a height corresponding to the level of liquid which can be achieved in the cavity 3.

During operation of the compressor, liquid separating, e.g. by gravity (see arrow G, schematically representing the gravity force), from the wet gas processed by the compressor accumulates on the bottom of the cavity 3. Through line 7, liquid also collects in the liquid-level measuring chamber 9. The liquid level in the liquid-level measuring chamber 9 and in cavity 3 is always at the same height due to the connecting line 7. The liquid level is indicated at L1 in FIG. 1. The liquid level L1 can be detected by the level gauge 15. In some embodiments the level gauge 15 is a magnetic level gauge. Suitable magnetic level gauges are Bont® magnetic level gauges, available from Cesare Bonetti s.p.a., Garbagnate Milanese, Italy.

The level gauge 15 can generate a signal when the liquid level L1 in the liquid-level measuring chamber 9 achieves a threshold TH. Through the control unit 17 the signal generated by the level gauge 15 triggers opening of the drainage valve 21.

The level gauge 15 and the control unit 17 can be configured and arranged so that the control unit 17 continually receives information on the liquid level L1 in the liquid-level measuring chamber 9. The threshold level TH can be set by a programmer in the control unit 17 and the control unit 17 generates a drainage-valve opening signal when the level signal from the level gauge 15 indicates that the threshold level has been reached. Alternatively, as mentioned above, the level gauge 15 can be configured to generate an alarm signal or a valve opening signal only upon reaching the threshold TH by the liquid level L1. The alarm signal is delivered to the control unit 17 and, based upon said alarm signal, the control unit 17 opens the drainage valve 21.

In some embodiments, a second liquid level threshold TH1 can be provided, above the liquid level threshold TH. The control unit 17 can be configured such that when the second threshold TH1 is achieved, the compressor is promptly stopped to prevent damages.

Drainage of the compressor can be done during pressurized stops or while the compressor is running (for those cavities where the internal pressure is sufficiently high to prevent condensates back flow). A check valve 22 can also be provided downstream of the drainage valve 21, to prevent back-flow towards the machine cavities.

A reliable liquid level control in cavity 3 is obtained and the compressor can be safely operated continuously by checking the liquid level in cavity 3. Liquid is drained when needed by opening the drainage valve 21, thus avoiding excess accumulation of liquid in the turbomachine.

Once the drainage valve 21 has been opened under the control of the control unit 17, it can be closed again e.g. after a pre-set time interval, which is calculated as being sufficient to drain the cavity 3. In other embodiments, closure of the valve 21 can be controlled e.g. by a further threshold level, lower than threshold level TH. Once the liquid in the liquid-level measuring chamber 9 reaches this lower threshold, the cavity is almost empty and the drainage 21 valve can be closed.

Figure 2:
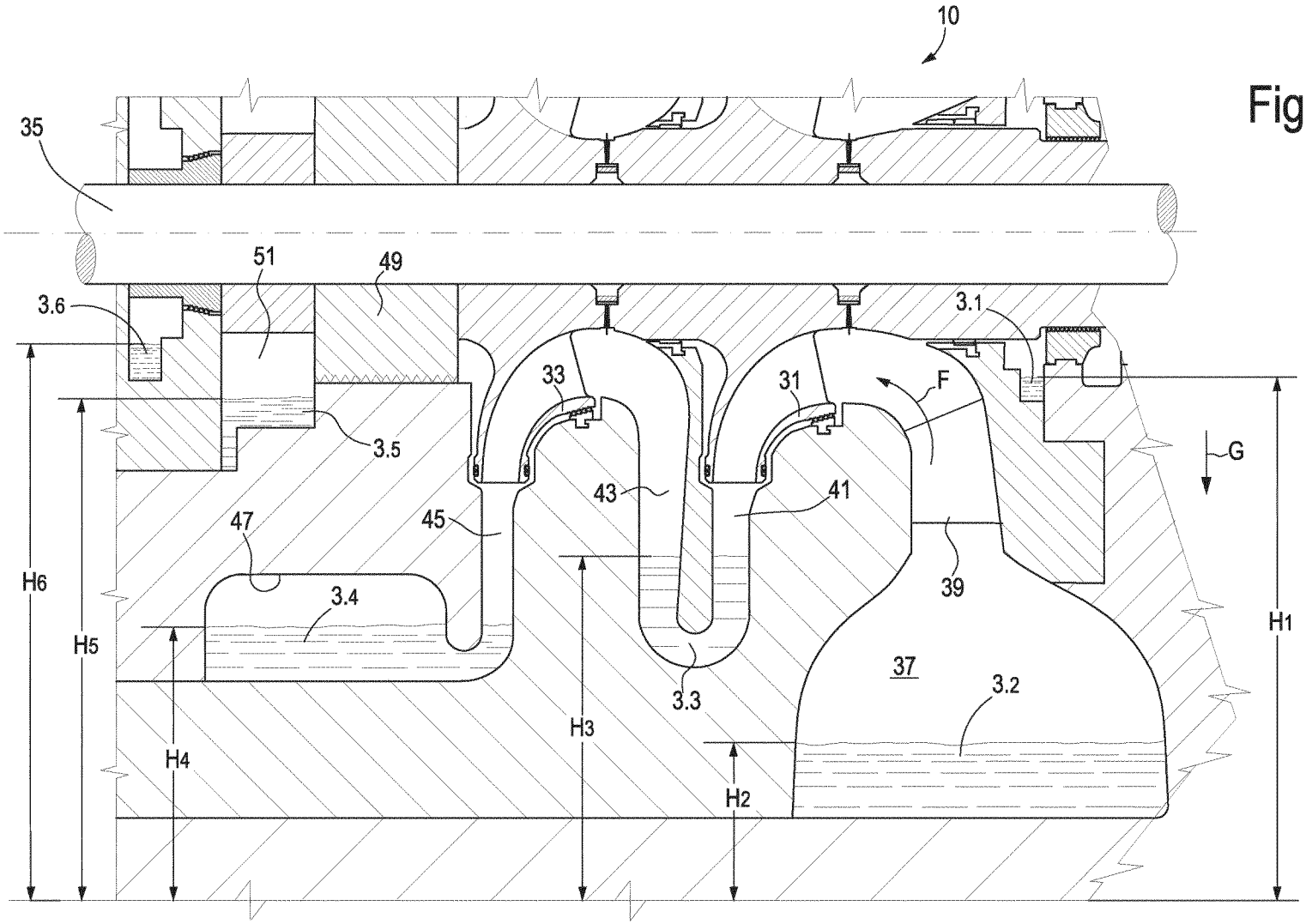
FIG. 2 schematically illustrates a sectional view of a portion of an exemplary centrifugal compressor with a plurality of cavities for collection of liquid separating from the wet gas being processed by the compressor.

The general principle described so far with respect to FIG. 1 can be embodied in a compressor, for example a wet-gas centrifugal compressor as schematically shown in FIG. 2, combining a liquid-level measuring chamber 9 with each cavity of the centrifugal compressor where liquid can accumulate. In the sectional view of FIG. 2, a two stage centrifugal compressor 10 is shown, comprised of a casing 1 and a rotor arranged for rotation in the casing. The rotor comprises two impellers 31, 33 mounted on a shaft 35 rotatingly supported in casing 1.

In other embodiments, a different number and configuration of impellers 31, 33 can be provided, depending upon the design of the compressor 10.

In the exemplary embodiment shown in FIG. 2, compressor 10 is provided with a gas inlet plenum 37 and inlet guide vanes 39, where through wet gas is delivered (see arrow F) towards the first impeller 31.

Gas is accelerated by the rotating impeller 31 and is discharged in a diffuser 41, in fluid communication with a return channel 43. Part of the kinetic energy of the gas accelerated by the impeller 31 is converted into pressure energy in the diffuser 41. The partly compressed gas enters the second impeller 33 and is again accelerated thereby and collected in a second diffuser 45, where kinetic energy of the gas delivered by the second impeller 33 is converted into pressure energy.

A volute 47 collects the gas delivered by the second impeller 33 through the second diffuser 45 and delivers it towards a delivery manifold (not shown).

In the exemplary embodiment of FIG. 2, the compressor 10 comprises a balancing drum 49 mounted for rotation on the shaft 35. On the side opposite the impeller 33, a balancing chamber 51 is provided adjacent the balancing drum 49. In a way known per se, the balancing chamber 51 can be in fluid communication with the inlet plenum 37 to generate on shaft 35 an axial thrust, which at least partly balances the axial trust generated by the impellers 31 and 33 during operation of compressor 10.

In various positions inside the casing 1 of compressor 10, a plurality of liquid collecting cavities are provided. By way of example only, in the schematic of FIG. 2, six liquid collecting cavities are depicted and numbered 3.1, 3.2, 3.3, 3.4, 3.5, 3.6. The number, shape and location of the liquid collecting cavities 3.1-3.6 are only by way of example, it being understood that the number, form, dimension and location of these cavities depend upon the specific compressor design.

Each liquid collecting cavity 3.1-3.6 can be in fluid communication with a corresponding liquid-level measuring chamber in quite the same way as schematically shown in FIG. 1 for the generic liquid collecting cavity 3.

Each liquid collecting cavity 3.1-3.6 can therefore be provided with a corresponding liquid-level measuring chamber, not shown, in some embodiments arranged outside the casing 1. Each liquid-level measuring chamber can be configured and arranged as described above with respect to the generic liquid-level measuring chamber 9 and provided with a level gauge 15.

Each liquid-level measuring chamber can be in fluid communication with a respective liquid collecting cavity 3.1-3.6 through a respective drain port and vent port quite in the same way as schematically shown in FIG. 1 for cavity 3, vent port 13 and drain port 5.

The liquid gauges of the various liquid collecting cavities 3.1-3.6 can be connected to a single control unit 17, which is in turn connected to the various drainage valves provided for each liquid collecting cavity 3.1-3.6, so that signals from the various level gauges can be processed by a common control unit, which controls opening and closing of the different drainage valves. In other embodiments, a separate control unit can be provided for each liquid gauge and relevant drainage valve, combined with each liquid collecting cavity.

In FIG. 2 reference numbers H1-H6 indicate the threshold liquid level for each liquid collecting cavity 3.1-3.6. As can be appreciated from FIG. 2, each liquid collecting cavity 3.1-3.6 has a different liquid level threshold, depending upon the shape and location of the cavity. Separate liquid-level measuring chambers with respective level gauges 15 can thus control separately the liquid level in each liquid collecting cavity.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A wet-gas compressor comprising:

a compressor casing comprising at least one cavity where liquid contained in a wet gas processed by the compressor collects during processing of the wet gas;

a rotor arranged for rotation in the compressor casing and comprised of at least one impeller;

a liquid-level measuring chamber including a first inlet port and a second inlet port;

a drain port at a bottom of said at least one cavity and configured to fluidly couple the at least one cavity to the first inlet port of the liquid-level measuring chamber;

a vent port in a position above the drain port of the at least one cavity and configured to fluidly couple the at least one cavity to the second inlet port of the liquid-level measuring chamber;

a level gauge combined with the liquid-level measuring chamber;

a drainage valve arranged for discharging liquid from the at least one cavity towards a liquid discharge line fluidly connected to the drain port through said drainage valve;

a control arrangement configured to receive a signal from the level gauge and to control the drainage valve such that the drainage valve is opened when liquid in the liquid-level measuring chamber reaches a threshold level.

2. The compressor of claim 1, wherein the liquid-level measuring chamber is arranged so that the liquid levels inside said liquid-level measuring chamber and said at least one cavity are at the same height with respect to the drain port.

3. The compressor of claim 2, further comprising:

in said compressor casing at least a further cavity for collecting liquid contained in the wet gas processed by the compressor;

a further drain port at a bottom of said further cavity;

a further vent port in a position above the further drain port of the further cavity, the further drain port and vent port being in fluid communication with a further liquid-level measuring chamber;

a further level gauge combined with the further liquid-level measuring chamber;

a further drainage valve arranged for discharging liquid from the further cavity towards a liquid discharge line.

4. The compressor of claim 3, wherein the further level gauge is connected to the control arrangement, which is configured for receiving a signal from the further level gauge and for controlling the further drainage valve, such that the further drainage valve is opened when liquid in the further liquid-measuring chamber reaches a threshold level.

5. The compressor of claim 4, wherein the control arrangement comprises a single control unit for controlling the drainage valve and the further drainage valve; or a first control unit for controlling the drainage valve and a further control unit for controlling the further drainage valve.

6. The compressor of claim 1, wherein the level gauge is arranged outside the compressor casing.

7. The compressor of claim 1, wherein the level gauge is a magnetic level gauge.

8. The compressor of claim 1, further comprising a check valve downstream of the drainage valve.

9. The compressor of claim 1, configured as a centrifugal compressor.

10. A method for removing a liquid accumulated in a wet-gas compressor comprising a compressor casing and at least one impeller arranged for rotation in the compressor casing; the method comprising the following steps:

providing at least one cavity in the compressor casing;

providing a drain port arranged at the bottom of the cavity and a vent port arranged above the drain port;

fluidly connecting the drain port with a first inlet port of a liquid-level measuring chamber and the vent port with a second inlet port of the liquid-level measuring chamber, wherein the liquid-level chamber is provided with a level gauge;

providing a drainage valve between the cavity and a liquid discharge line;

running the compressor and processing wet gas therethrough;

collecting liquid, separating from the wet gas processed by the compressor, in the cavity;

detecting a liquid level in the liquid-level measuring chamber;

if the liquid in the liquid-level measuring chamber reaches a first threshold level, opening the drainage valve and discharge liquid from the cavity and from the liquid-level measuring chamber through the drainage valve.

11. The method of claim 10, wherein the drainage valve is opened and liquid is discharged without stopping the compressor.

12. The method of claim 10, wherein the liquid-level measuring chamber is arranged outside the compressor casing.

13. The method of claim 10, further comprising the step of arranging a check-valve downstream of the drainage valve.

14. The method of claim 10, wherein the wet-gas compressor is stopped when a second threshold of liquid level is reached inside the liquid-level measuring chamber, the second threshold being higher than the first threshold.

* * * * *